US006244450B1

(12) United States Patent
Woodling

(10) Patent No.: US 6,244,450 B1
(45) Date of Patent: Jun. 12, 2001

(54) METHOD AND APPARATUS FOR TELESCOPING BOOM WITH HYDRAULIC EXTENSION ACTUATORS

(75) Inventor: Roger Woodling, Omaha, NE (US)

(73) Assignee: Elliott Equipment Company, Omaha, NE (US)

( * ) Notice: Subject to any disclaimer, the term of this patent is extended or adjusted under 35 U.S.C. 154(b) by 0 days.

(21) Appl. No.: 09/416,810

(22) Filed: Oct. 13, 1999

(51) Int. Cl.[7] ..... B66C 23/04
(52) U.S. Cl. ..... 212/349; 212/231
(58) Field of Search ..... 212/348, 349, 212/350, 231; 52/118

(56) References Cited

U.S. PATENT DOCUMENTS 3,445,004 * 5/1969 Grider et al. ..... 212/349
3,807,108 * 4/1974 Johnston ..... 212/349

* cited by examiner

*Primary Examiner*—Thomas J. Brahan
(74) *Attorney, Agent, or Firm*—Philip J. Lee

(57) ABSTRACT

A method of constructing a five section telescoping aerial lift, crane or similar vehicle-mounted equipment and a lift constructed in accordance with the method having one end pivotally secured, about a horizontal axis, to the pedestal and the other end of the telescoping boom is equipped with a sheave for rigging the turret winch lift-line and/or it is equipped with a platform assembly for positioning workers, tools, or other devices at high positions, the four telescoping boom sections being extended and retracted individually by means of one hydraulic actuator for each moving section, two actuators located in the interior of the boom sections and two actuators located on the exterior of the boom sections.

13 Claims, 9 Drawing Sheets

METHOD AND APPARATUS FOR TELESCOPING BOOM WITH HYDRAULIC EXTENSION ACTUATORS

BACKGROUND OF THE INVENTION

A. Field of Invention

The present invention relates generally to methods of constructing and controlling moving telescoping boom sections of an aerial lift or other device and a telescoping boom constructed in accord with the method, and more particularly to a new and improved method of constructing and controlling moving telescoping boom sections of an aerial lift or other device, each of the boom sections being extended or retracted by a hydraulic cylinder and a new and improved telescoping boom apparatus constructed in accord with said method, having, for each moving section, a rigidly affixed hydraulic cylinder.

B. Description of Related Art

Many types of aerial lifts, cranes and similar telescoping boom devices have been provided. Further, many of these use a hydraulic actuator to extend or retract the boom. However, it is not believed that any of these devices use an individual hydraulic actuator for each moving section, such lifts instead conventionally using chains, cables, or the like in pulley systems to achieve the extension and retraction of the boom sections. Nor do conventional lifts have rigidly mounted hydraulic actuators or sliding supports on the hydraulic actuator piston rods.

SUMMARY OF THE INVENTION

In the present invention, an aerial lift or crane or similar device is mounted on a vehicle that may be a self-propelled chassis, a highway truck or a trailer having rearward and forward ends. A rotatable pedestal is provided on the vehicle and has an elongated telescoping boom assembly pivotally mounted to the pedestal about a horizontal axis. The outer end of the boom structure may have an aerial lift platform or a sheave for the load line or other devices for supporting the load or ancillary equipment. The present invention comprises the method of construction and control of the telescoping boom assembly comprising a main boom section fixed to the pedestal and at least two and up to four elongated moveable beam structures, all of which beams have a similar cross-sectional shape, preferably square or rectangular. The base beam and the moveable beams are elongated and hollow with successively smaller cross-sectional dimensions such that they can telescope within one another, the largest being the base beam. The moving sections of the boom are telescoped into and out of each other and the base beam by means of double acting linear hydraulic actuators connected between each moving section and the next beam section into which it telescopes. A series of switches and electric valves control the sequence of extension of the hydraulic actuators. In a five section boom, two of the hydraulic actuators are positioned within the interior of the boom sections and the other two hydraulic actuators are externally positioned. To improve the buckling strength of the hydraulic actuators, the piston rods and hydraulic cylinder cases are rigidly mounted to the stationary and moving boom sections. In order to support the long hydraulic actuator piston rods that are externally positioned along the elongated boom, sliding supports are provided. The sliding piston rod supports are pushed out with the extending hydraulic actuator rod by means of blocks on the extending boom and are restrained from over extending by a telescoping restraint assembly. The support assembly is positioned by means of blocks on the moving section and a slide-tube restraint on the hydraulic cylinder case. No chains, cables or other devices are used to allow one hydraulic actuator to extend or retract more than one section. Since the results of a failure of one or more of the hydraulic actuators is the relatively slow descent of the top end of the boom, the present invention is a safer method of extending the boom sections than conventional methods using chains, cables or the like which are subject to complete sudden failure with possibly violent results. In addition, each hydraulic actuator is protected by a locking valve which prevents inadvertent activation or failure of the actuator. It is therefore the principle aim of the present invention to provide a method of constructing and controlling a new and improved aerial lift, crane or other boom device which meets the foregoing requirements and is capable extending and retracting completely with one linear hydraulic actuator for each moving section.

Another and further object and aim of the present invention is to provide a new and improved aerial lift which meets the foregoing requirements and which includes a stronger hydraulic actuator rod with fixed rigid ends.

Another and further object and aim of the present invention is to provide a new and improved aerial lift which meets the foregoing requirements and which includes a supported hydraulic actuator rod with a sliding support mechanism.

Another and further object and aim of the present invention is to provide a new and improved method of constructing and controlling an aerial lift which meets the foregoing requirements and which is safe to operate.

Other objects and advantages of the invention will become apparent from the Description of the Preferred Embodiments and the Drawings and will be in part pointed out in more detail hereinafter.

The invention consists in the features of construction, combination of elements and arrangement of parts exemplified in the construction hereinafter described and the scope of the invention will be indicated in the appended claims.

DESCRIPTION OF THE PREFERRED EMBODIMENT(S)

Figure 1:
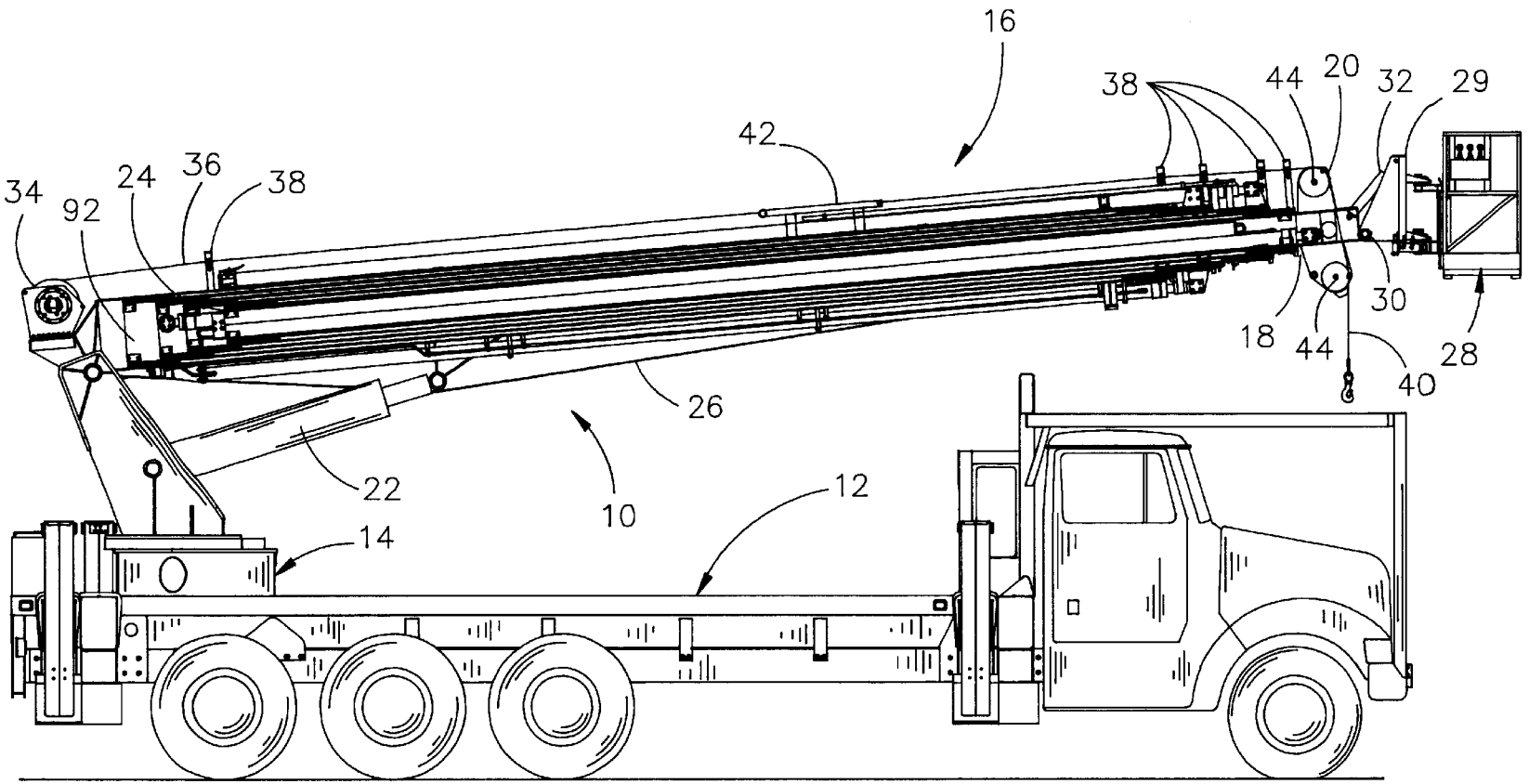
FIG. 1 is a side view of an aerial lift apparatus constructed in accord with the present invention showing the boom assembly in sectional view and the conventional truck on which the apparatus may be mounted shown in broken outline.

With reference to the Drawings wherein like numerals represent like parts throughout the Figures, an aerial lift apparatus constructed in accordance with the method of the present invention is generally designated by numeral 10 in FIG. 1. Aerial lift 10 may be mounted on a trailer vehicle or self-propelled vehicle such as a truck 12 or the like by a rotatable pedestal 14. Lift 10 is generally used for lifting a person vertically and/or moving the person laterally and for that reason, the use of "upper" and "outer" in this description means in the direction away from the pedestal 14 and the use of one of said terms does not negate or exclude the applicability of the other. For the sake of clarity of description, the lift 10 will be described as having a top or upper side and a bottom or lower side, as it would have if deployed in a vertical or upwardly angled position although it will be appreciated that the lift also may be extended horizontally and the terminology is not intended as a limitation of the angle of the lift, either in construction or use. Aerial lift 10 is mounted on a conventional horizontally rotatable pedestal 14 and comprises a telescoping boom structure or assembly 16. The bottom end 92 of boom assembly 16 is pivotally secured, about a horizontal axis, to the upper end of pedestal 14. Boom assembly 16 is conventionally vertically pivotable with respect to pedestal 14 by one or more externally positioned hydraulic actuators 22.

For purposes of description, boom assembly 16 will be described as a five section assembly including a main lower boom 26, an upper boom section 18, and 3 center sections 56, 50, and 48 assembled between the lower boom 26 and the upper boom section 18. It is to be understood that the preferred embodiment of the lift 10 constructed in accord with the present invention comprises boom assemblies using a plurality of boom sections and alternate versions of boom assembly 16 may be constructed by eliminating some or all of the described center sections 56 and 50, or by adding additional center sections of similar construction, without departing from the spirit of the invention. The upper boom section 18 comprises an inner end 24 and an upper and outer end 20. In the illustrated preferred embodiment, all boom sections have a similar cross-sectional shape, preferably generally square or rectangular with reinforced sections as needed, all boom sections are elongated and hollow, with successively smaller cross-sectional dimensions such that the outside dimensions of upper boom section 18 are smaller than the inside dimensions of uppermost center section 48 such that section 18 can be retracted into section 48. Similarly, the outside dimensions of boom section 48 are smaller than the inside dimensions of center section 50 such that section 48 can be retracted into section 50, and the outside dimensions of boom section 50 are smaller than the inside dimensions of center section 56 such that section 50 can be retracted into section 56. Further, the outside dimensions of boom section 56 are smaller than the inside dimensions of main lower boom section 26 such that section 56 can be retracted into section 26. According to the method of the present invention, the boom sections can telescope by being retractable into and extended out of each other. Wear pads 25, formed of a low friction material are placed on the boom section surfaces that would otherwise be in frictional contact to prevent such contact.

Upper boom end 20 includes a support pivot 29 for various types of personnel baskets, an example of which is shown and identified by numeral 28, which may be included on the boom 16 to form an aerial lift. Basket 28 is typically attached to the outer end 20 of the upper boom 18 by means of a pin 30 and the basket is maintained in a level position by means of leveling hydraulic cylinders 32.

In addition to the personnel basket 28, a conventional cable winch 34 may be fitted to the boom assembly. The cable winch may be positioned at the upper end of pedestal 14, or the inner end of main lower boom 26 if so desired, and has a winch cable 36 extending or retracting therefrom along the length of the boom assembly 16. As seen in FIG. 1, a series of cable supports 38 are mounted on boom assembly 16 for supporting the cable 36 thereon at times. Additionally the free end 40 of the cable 36 may be secured to the spring-loaded retainer assembly 42 when the cable 36 is not being used. Cable sheaves 44 at the upper and outer end 20 of the upper boom 18 provide for rigging the winch cable 36 in a vertical plane for lifting loads attached to the free end 40 of the cable 36.

The preferred embodiment of the method comprises an adaptation of the conventional telescoping boom assembly by providing a separate hydraulic linear actuator for each boom section to allow the operator to individually and sequentially extend and retract the sections.

Figure 2:
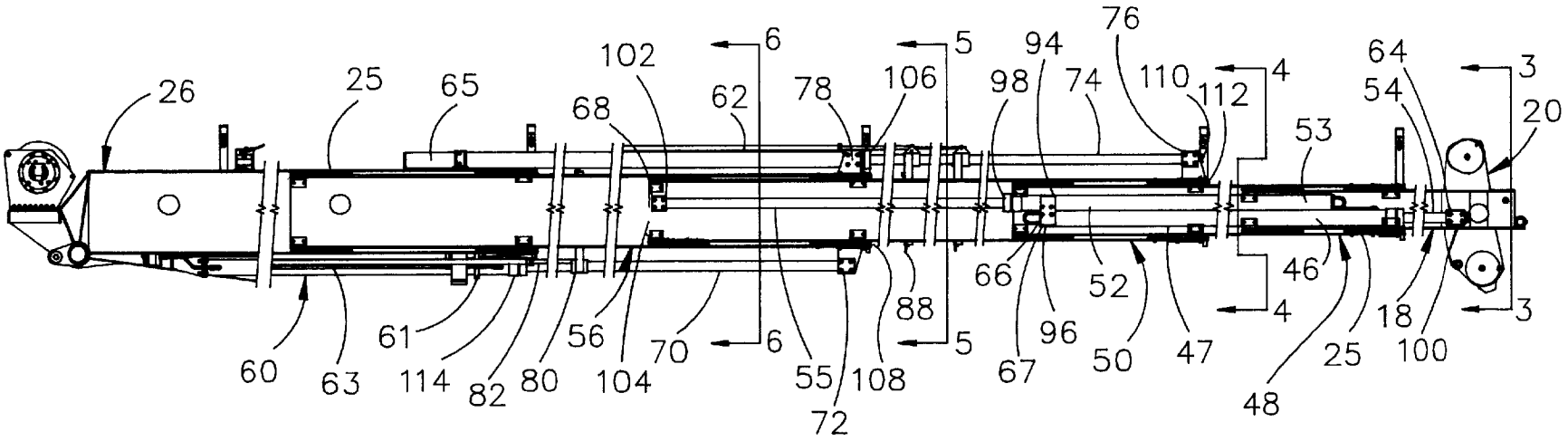
FIG. 2 is a longitudinal partial sectional side view of a preferred embodiment of a boom assembly of an aerial lift constructed in accord with the present invention, the boom sections shown partially extended and broken lengthwise.
Figure 3:
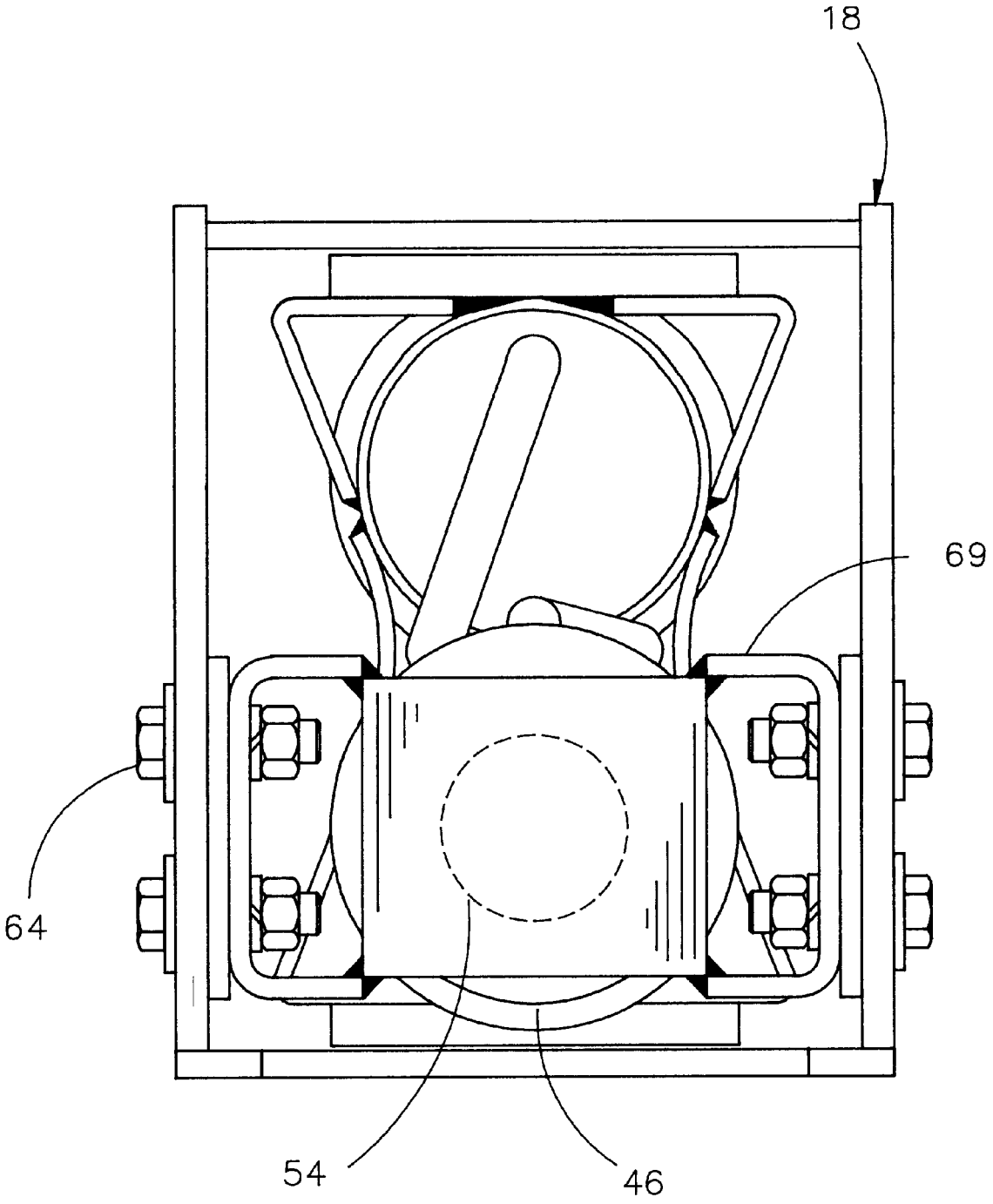
FIG. 3 is a sectional view taken along line 3—3, shown in FIG. 2, of a preferred embodiment of a rigid mount of the internal hydraulic cylinder rod for extending or retracting a boom section in accord with the present invention.
Figure 4:
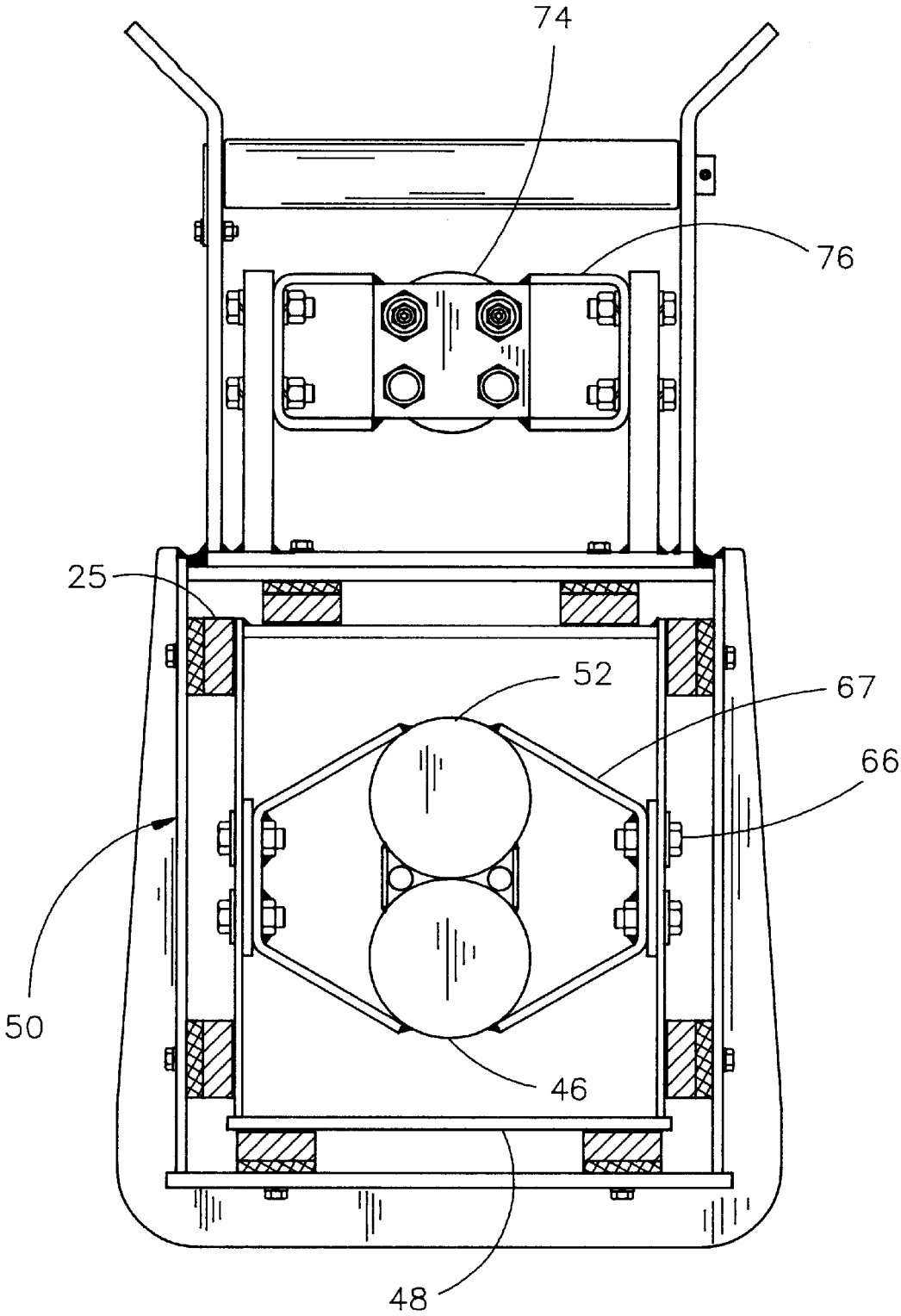
FIG. 4 is a sectional view taken along line 4—4, shown in FIG. 2, showing the rigid mount of the internal hydraulic cylinder cases for extending or retracting the smallest and the next-to-smallest boom sections and for a 5-section boom, the rigid mount of the middle boom hydraulic cylinder rod.

As shown in FIG. 2, the method comprises placement of the hydraulic actuator 46 that extends or retracts the smallest top boom section 18 as well as the hydraulic actuator 52 that extends or retracts the smallest center section 48 of boom 16, both hydraulic actuators 46 and 52 being positioned internally within the interior of sections 18 and 48. Hydraulic actuators 46 and 52, as all of the hydraulic actuators, comprise a piston rod 54 and 55 having a piston end and an actuator end, and an elongated cylinder 47 and 53 having a closed end and an open end into which the piston end of the piston rod is received. In the illustrated preferred embodiment, as an example only and not a limitation, the hydraulic actuators, except the main lift actuator 22, use 3.5 inch diameter cylinders with 2.5 inch diameter piston rods. It is anticipated that other sizes of actuators could be used provided the changes in characteristics were accommodated. The piston rod of hydraulic actuator 46 is designated by numeral 54 and the piston rod of hydraulic actuator 52 is designated by numeral 55. The hydraulic cylinder of hydraulic actuator 46 is designated by numeral 47 and the hydraulic cylinder of hydraulic actuator 52 is designated by numeral 53.

Figure 5:
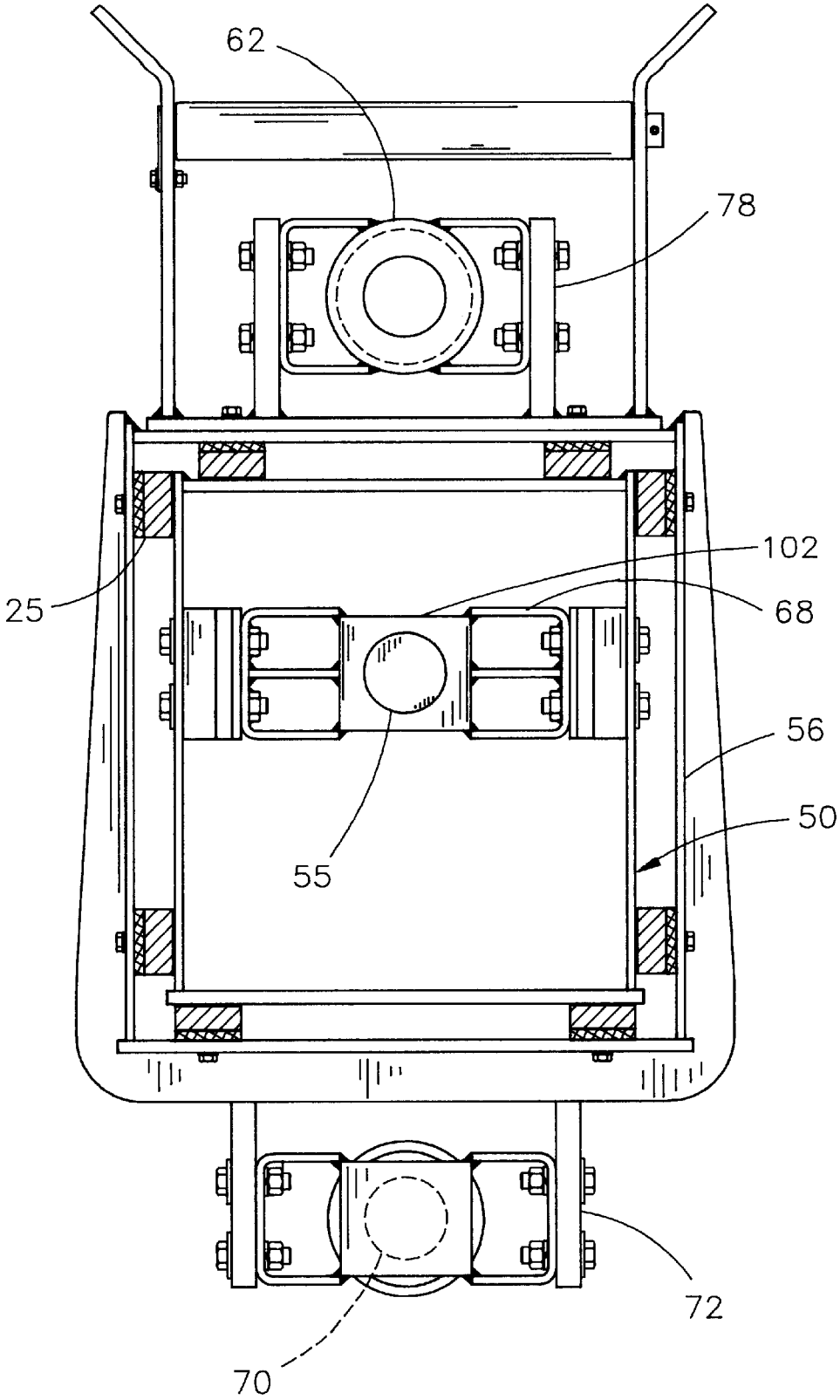
FIG. 5 is a section view taken along line 5—5, shown in FIG. 2, showing the rigid mount of hydraulic cylinder rod for extending or retracting the next-to-smallest boom section and in the case of a 5-section boom, the rigid trunnion mount of the middle boom hydraulic cylinder case and in the case of a 4 or 5-section boom, the rigid mount of the hydraulic cylinder rod for extending or retracting the next-to-largest boom section.

The closed end 96 of hydraulic cylinder 47 and the open end 98 of hydraulic cylinder 53 are both secured within the interior of section 48 adjacent the lower (closer to the pedestal) end 94 thereof by an attachment bracket 67 secured by bolts 66. The actuator end 100 of piston rod 54 is secured within the interior of upper boom section 18 adjacent the upper end 20 of section 18 by means of a bolted fixed end attachment bracket 69 secured by bolts 64. FIG. 5 shows actuator end 102 of piston rod 55 is rigidly secured within the interior of center boom section 50 adjacent the lower end 104 of section 50 by means of a fixed, bolted bracket 68. According to the preferred embodiment, actuator 46 extends piston rod 54 upward and actuator 52 extends piston rod 55 downward.

Figure 6:
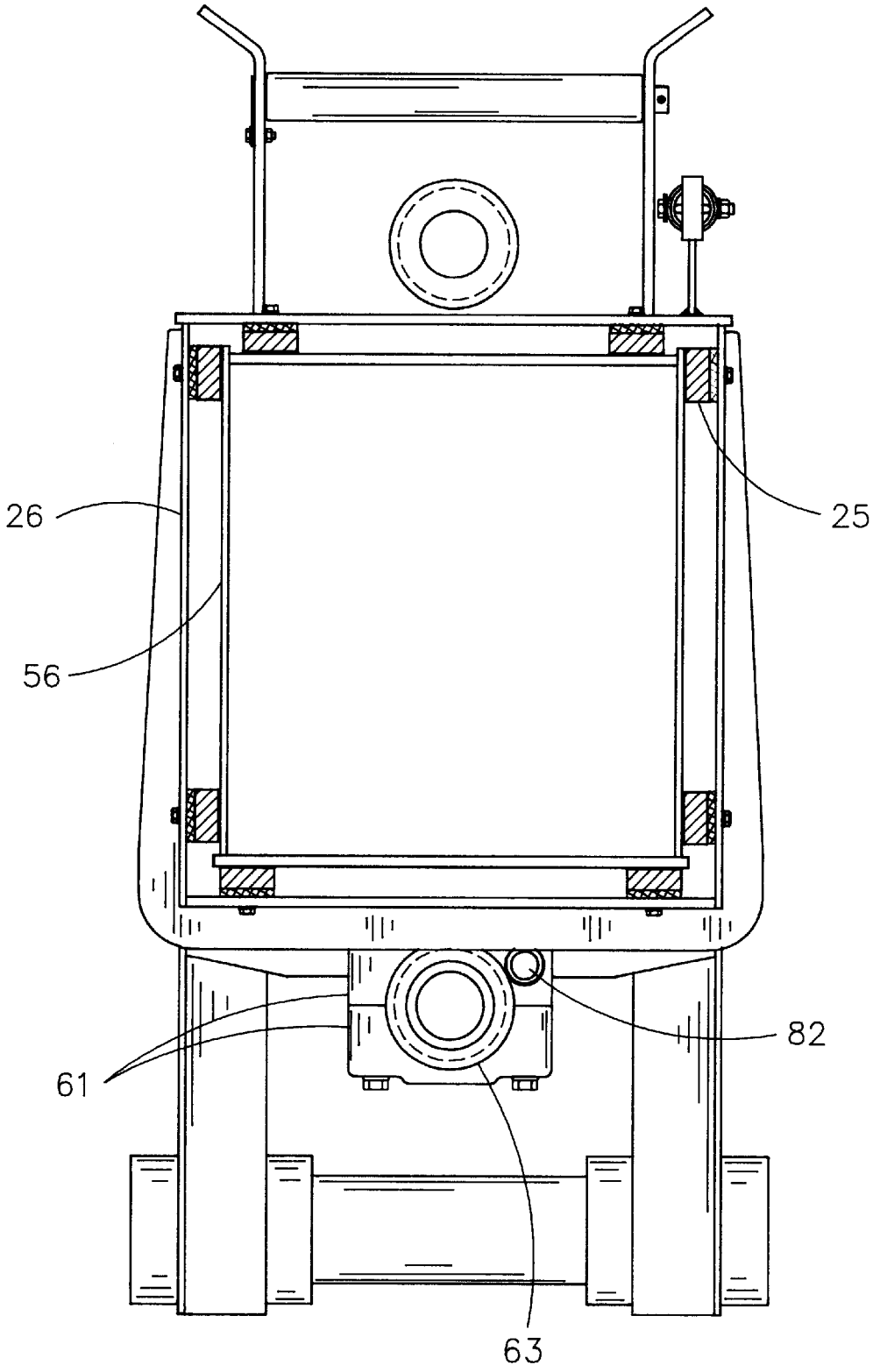
FIG. 6 is a section view taken along line 6—6, shown in FIG. 2, showing the rigid saddle mount of the hydraulic cylinder case for extending or retracting the next-to-largest boom section.

When, as in the illustrated preferred embodiment, the boom assembly 16 is comprised of 4 or 5 telescoping boom sections, the next-to-largest boom section 56 is telescoped into and out of the lower main boom section 26 by means of hydraulic actuator 60 the cylinder 63 of which is rigidly installed on the exterior of the main boom section 26. The middle boom section 50 is telescoped into and out of the next-to-largest boom section 56 by means of hydraulic actuator 62, the cylinder 65 of which is also installed on the exterior of the main boom section 26 but not mounted thereon, being mounted on the upper end of boom section 56. In the illustrated preferred embodiment, hydraulic actuators 60 and 62 are shown as positioned on the bottom and top sides of main boom section 26, respectively, however, it is to be understood that the exact placement of the actuators is a matter of design preference which may vary, particularly in the event more or fewer center boom sections are used. As shown in FIG. 5, the open end 106 of hydraulic cylinder 65 of actuator 62 is secured by rigid trunnion mount 78 located on the upper side of the upper end 108 of boom section 56 and actuator end 110 of piston rod 74 which is received in cylinder 65 is rigidly secured by a bolted bracket 76 to the top side of the upper end of middle boom section 50. Trunnion mount 78 supports actuator cylinder 65 in a position parallel to the boom section 56 and vertically displaced upward so that when boom section 50 is retracted, cylinder 65 remains outside of boom sections 56 and 26. As shown in FIG. 6, hydraulic cylinder 63 of actuator 60 is secured by a rigid saddle mount 61 located on the bottom side of main boom section 26 at the upper end of section 26. The actuator end 72 of piston rod 70 of actuator 60 is rigidly attached to the bottom side of the upper end 108 of boom section 56.

Figure 7:
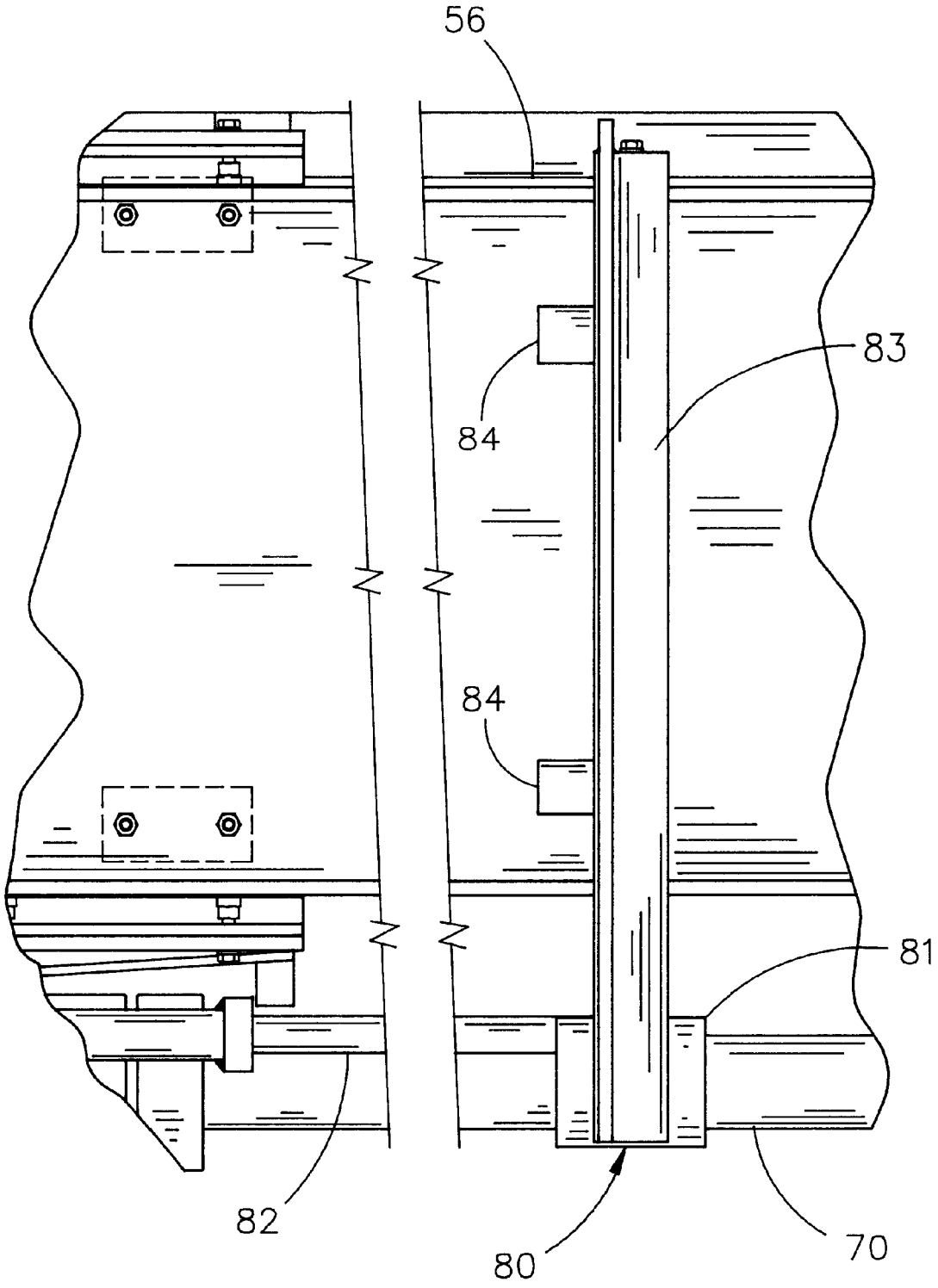
FIG. 7 is an enlarged view of the lower external hydraulic cylinder rod support assembly.
Figure 8:
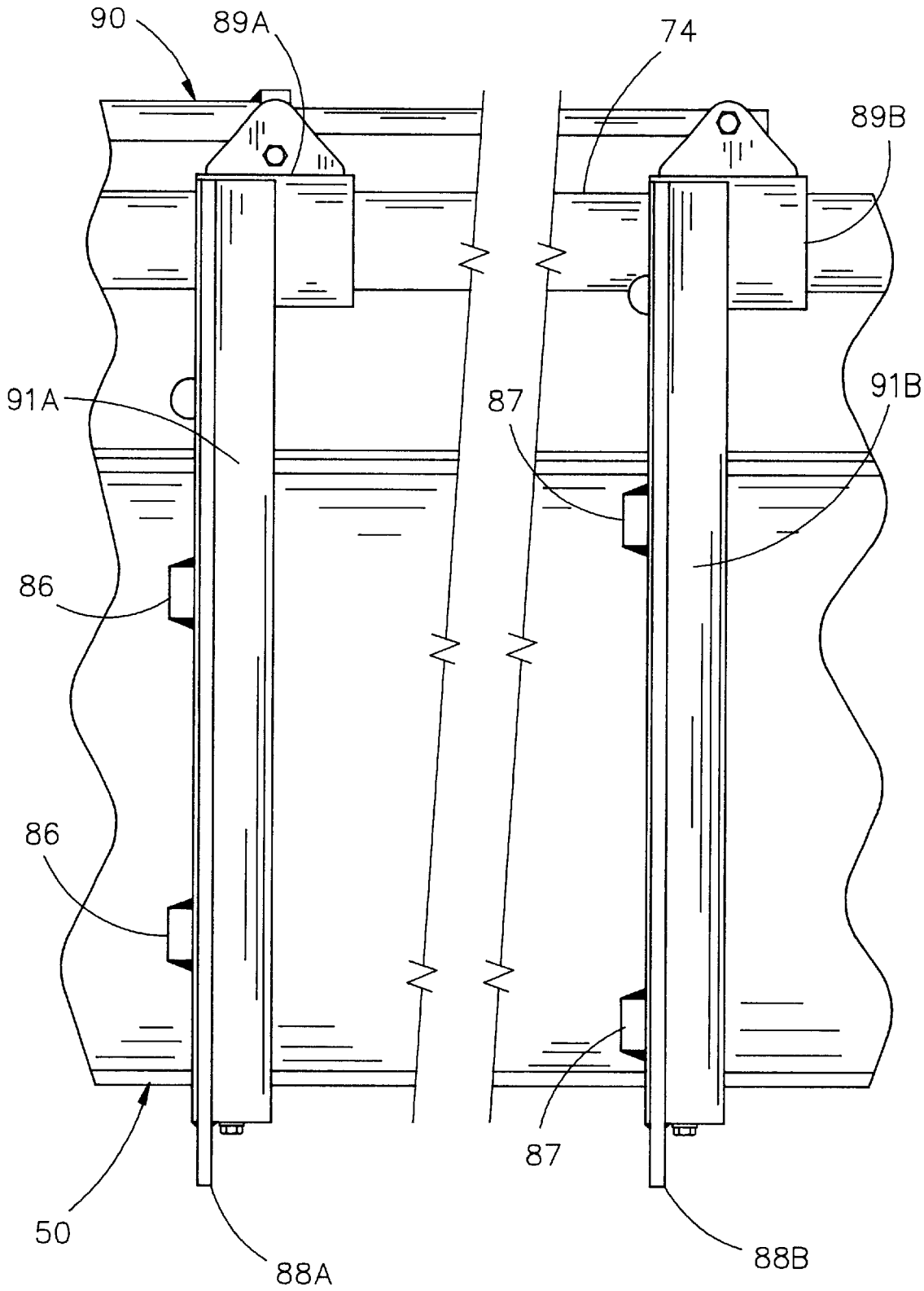
FIG. 8 is an enlarged view of the upper external hydraulic cylinder rod support assemblies.
Figure 9:
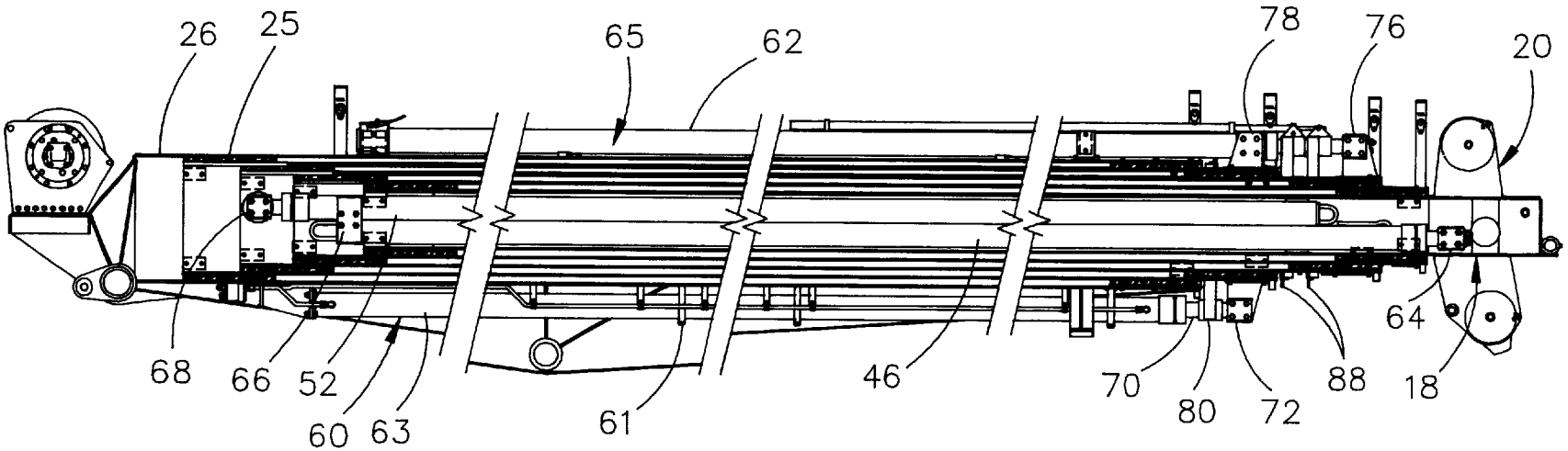
FIG. 9 is a sectional side view of the retracted boom assembly of an aerial lift constructed in accord with the present invention and its associated mounting.

The piston rods 70 and 74, being external to the boom sections are not supported against lateral distortion and buckling by the interior of the boom as are the internally located rods 54 and 55. To provide support for the external piston rods 70 and 74, sliding support brackets are provided as shown in FIGS. 7 AND 8. Support bracket 80 which supports rod 70 comprises a sleeve 81 through which rod 70 is free to slide, and a collar 83 around boom section 56 which is allowed to slide over the exterior of boom section 56. Raised stops 84 are located on the exterior of boom section 56 at approximately the middle of the length of boom section 56 and rod support bracket 80 is located between the stops and the upper end 108 of section 56. A sliding restraint 82 limits the displacement of the rod support bracket 80 from the open end 114 of hydraulic actuator cylinder 63. As boom section 56 is retracted, rod support bracket 80 is retracted with, by and adjacent to the attachment of the actuator end of rod 70 at the upper end 108 of boom section 56. When boom section 56 is extended, stops 84 engage collar 83 to extend rod support bracket 80 to approximately the middle of rod 70 and restraint 82 prevents further movement of rod support bracket 80, which is thereby securely located to support the middle of rod 70. In addition, all actuator rods and cylinders are described as rigidly fixed or installed, by which is meant the bolted brackets 76, 78, 80, and 69 which provide more support against buckling than do conventional clevis pin type connectors.

As shown in FIG. 8, two rod support brackets 88A and 88B, similar in design to support bracket 80, support piston rod 74. rod support brackets 88A and 88B both comprise a sleeve 89A and 89B through which rod 74 is free to slide, and a collar 91A and 91B around boom section 50 which is allowed to slide over the exterior of boom section 50. Two sets of raised stops 86 and 87 are located on the exterior of boom section 50. Stops 86 are located at about one third of the length of boom section 50 and stops 87 are located at about two third of the length of boom section 50. Rod support bracket 88A is located between stops 86 and 87, and rod support bracket 88B is located between stops 86 and the upper end 112 of boom section 50. A sliding restraint 90 limits the displacement of the rod support bracket 88B from the open end 106 of hydraulic actuator cylinder 65. As boom section 50 is retracted, rod support brackets 88A and 88B are retracted with, by and adjacent to the attachment of the actuator end of rod 74 at the upper end 112 of boom section 50. When boom section 50 is extended, first, stops 87 engage collar 91B to extend rod support bracket 88B approximately two thirds of the length of rod 74 and restraint 82 prevents further movement of rod support bracket 88B, and stops 86 engage collar 91A to extend rod support bracket 88A approximately one third of the length of rod 74.

Each hydraulic actuator is supplied with hydraulic fluid from a central pump source and is controlled by a separate control system incorporating a conventional electrically controlled valve. A control circuit which may include a preprogrammed micro processor provides for the activation of the individual control valve systems. In the preferred embodiment, the control circuit is programmed using conventional means to extend and retract the boom sections in the desired sequence with the smallest section being extended first and retracted last; although it will be anticipated that the sequence and extent of activation of the individual actuators is a matter that can be varied according to the user's needs. Because of the use of individually controlled actuators for each section, any desired sequence or combination of activations are available without rerigging or modifying any of the physical elements of the lift 10.

It should be appreciated and anticipated that the dimensions given for the preferred embodiment are examples of an exemplary working system and are not meant to be the only dimensions by which the method of the present invention may be practiced. For example, the principles of the present invention may be applied to larger or smaller lifting apparati, provided that the strength and/or size of the components is adapted to the different loads and forces to be expected.

The following explanation uses the dimensions and affect of the preferred embodiment as an example to illustrate the method of the present invention in general to allow its use in other applications.

While preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A method of constructing a lifting apparatus with a plurality of elongated telescoping boom sections, the method comprising the steps of:

A. constructing a main boom section and at least 4 boom sections that telescope into the main boom section; and B. providing at least one linear hydraulic actuator comprising a cylinder and a piston rod to control the extension and retraction of each boom section, and C. rigidly securing each cylinder to a boom section and each piston rod to a boom section; and D. securing the actuator cylinders used to extend and retract the two smallest boom sections to the next to smallest boom section within and to the interior thereof; and E. positioning said actuators such that the smallest boom section can be retracted into the next to smallest boom section with said actuators extending into the interior of the smallest boom section.

2. The method of claim 1, wherein the method further comprises the steps of locating and securing the actuator of one or more boom section outside of the actuated boom section, and supporting the actuator rods that are not within the interior of a boom section when extended, between the rigidly secured rod and the cylinder.

3. A lifting apparatus with a plurality of elongated telescoping boom sections, the apparatus comprising a main boom section having an open interior and at least 4 hollow, telescoping boom sections of successively smaller outside dimension such that each boom section comprises an inner end and an outer end into which the next smaller boom section telescopes and all boom sections telescope into the main boom section, and at least one linear hydraulic actuator to control the extension and retraction of each boom section, each hydraulic actuator comprising a piston rod and a cylinder having a closed end and an open end into which the rod is inserted, and an attachment bracket securing both of the actuator cylinders used to extend and retract the two smallest boom sections within and to the interior of the next to smallest boom section and said actuators are positioned such when the smallest boom section is retracted into the next to smallest boom section, said actuators extend into the interior of the smallest boom section.

4. The apparatus of claim 3, wherein each hydraulic actuator cylinder is rigidly affixed to one of the boom sections.

5. The apparatus of claim 4, wherein each hydraulic actuator cylinder is individually controlled.

6. The apparatus of claim 5, wherein the telescoping boom sections comprise a first, smallest boom section, a second boom section larger than the first boom section, a third boom section larger than the second boom section, and a fourth telescoping boom section larger than the third boom section and smaller than the main boom section, both of the hydraulic actuator cylinders for the first and second boom sections are rigidly affixed to the interior of the second boom section.

7. The apparatus of claim 6, further comprising a first actuator rod being attached to the outer end of the first boom section and inserted into a first actuator, the closed end of which is rigidly affixed to the interior of the inner end of the second boom section and a second actuator rod being attached to the interior of the outer end of the third boom section.

8. The apparatus of claim 7, further comprising a third actuator rod being attached to the exterior of the outer end of the third boom section and inserted into a third actuator, the open end of which is rigidly affixed to the exterior of the outer end of the fourth boom section and a fourth actuator rod being attached to the exterior of the outer end of the fourth boom section and inserted into a fourth actuator which is rigidly affixed to the exterior of the main boom section.

9. The apparatus of claim 8, further comprising at least one sliding support slidingly surrounding the fourth boom section and supporting the fourth actuator rod and at least one sliding support slidingly surrounding the third boom section and supporting the third actuator rod.

10. A lifting apparatus comprising a plurality of elongated telescoping boom sections, each boom section comprises an inner end and an outer end into which the next smaller boom section telescopes and all boom sections telescope into a main boom section, and at least one linear hydraulic actuator to control the extension and retraction of each telescoping boom section, each hydraulic actuator comprising a piston rod and a cylinder having a closed end and an open end into which the rod is inserted, each piston rod being rigidly attached to a boom section and each cylinder being rigidly attached to an adjacent boom section and each actuator is individually controlled.

11. The apparatus of claim 10, further comprising an attachment bracket securing both of the actuator cylinders used to extend and retract the two smallest boom sections within the interior of the next to smallest boom section and wherein said actuators are positioned such when the smallest boom section is retracted into the next to smallest boom section, said actuators extend into the interior of the smallest boom section.

12. The apparatus of claim 11 wherein all actuators other than the actuators used to extend and retract the two smallest boom sections are attached to the exterior of the boom sections and the rod of each such actuator is supported by at least one sliding support slidably mounted on the boom section to which the rod is attached.

13. The apparatus of claim 12, wherein the telescoping boom sections comprise a first, smallest boom section, a second boom section larger than the first boom section, a third boom section larger than the second boom section, and a fourth telescoping boom section larger than the third boom section and smaller than the main boom section, both of the hydraulic actuator cylinders for the first and second boom sections are rigidly affixed to the interior of the second boom section.

* * * * *